United States Patent [19]

Steiner

[11] Patent Number: 4,756,702

[45] Date of Patent: Jul. 12, 1988

[54] PRETREATMENT PROCESS FOR FLAT TENSION MASK

[75] Inventor: Johann Steiner, Des Plaines, Ill.

[73] Assignee: Zenith Electronics Corporation, Glenview, Ill.

[21] Appl. No.: 948,212

[22] Filed: Dec. 31, 1986

[51] Int. Cl.[4] ..... H01J 9/00; H01J 29/07

[52] U.S. Cl. ..... 445/30; 445/47; 445/45

[58] Field of Search ..... 445/37, 47, 45, 30; 148/14

[56] References Cited

U.S. PATENT DOCUMENTS

| | | | |
|---|---|---|---|
| 2,625,734 | 1/1953 | Law | 445/4 |
| 3,390,447 | 7/1968 | Mears | 228/190 X |
| 3,809,945 | 5/1974 | Roeder | 445/47 X |
| 3,867,207 | 2/1975 | Decker et al. | 148/6.14 R |
| 3,894,321 | 7/1975 | Moore | 445/30 |
| 4,210,843 | 7/1980 | Avadani | 445/47 X |
| 4,528,246 | 7/1985 | Higashinakagawa | 148/12.1 X |
| 4,591,344 | 5/1986 | Palac | 445/45 |

*Primary Examiner*—Kenneth J. Ramsey

[57] ABSTRACT

A process for pre-treating a metal foil shadow mask is disclosed for use in a cathode ray tube wherein the shadow mask is maintained under high tension within said cathode ray tube, and wherein the mask is subjected to predetermined relatively high temperatures during tube manufacture. The process according to the invention comprises pre-heating the shadow mask in a predetermined cycle of temperature and time effective to minimize subsequent permanent dimensional changes in the mask that occur when it is subjected to the predetermined relatively high temperatures, but ineffective to significantly reduce the tensile strength of the mask by annealing.

2 Claims, 1 Drawing Sheet

Fig. 1
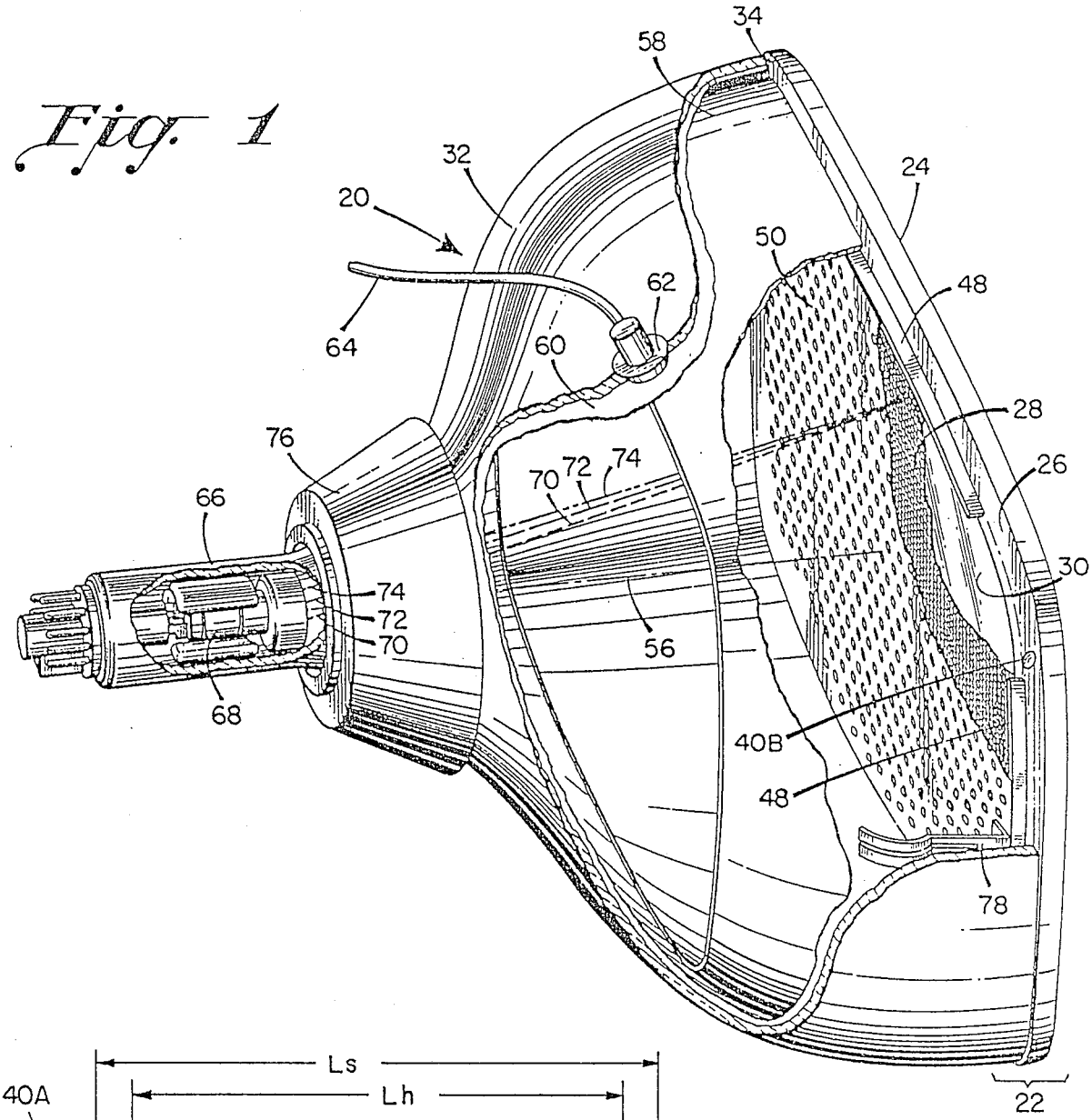
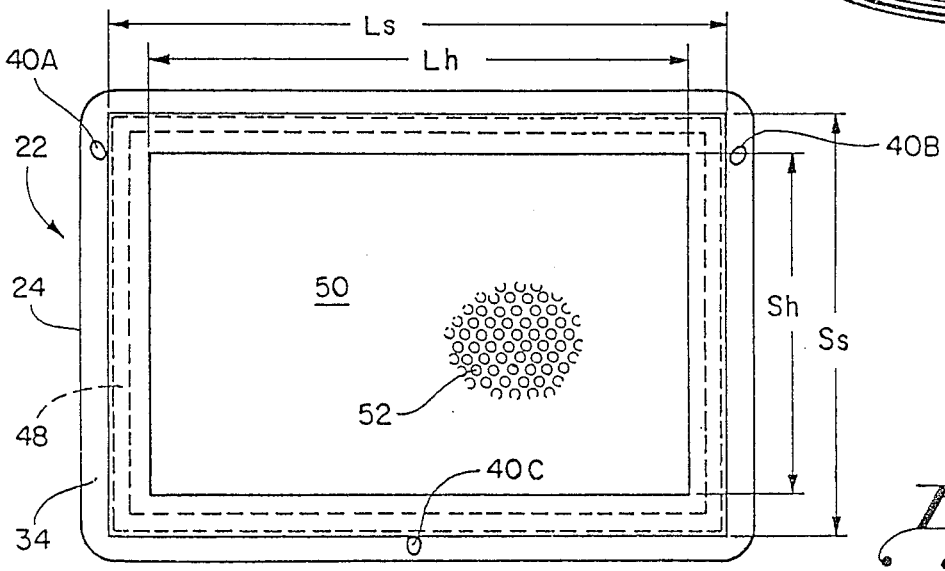
Fig. 2

PRETREATMENT PROCESS FOR FLAT TENSION MASK

CROSS-REFERENCE TO RELATED APPLICATIONS AND PATENTS

This application is related to but in no way dependent upon copending applications Ser. No. 729,020 filed Apr. 30, 1985, now U.S. Pat. No. 4,652,791; Ser. No. 832,493 filed Feb. 21, 1986, now U.S. Pat. No. 4,730,143; Ser. No. 832,556 filed Feb. 21, 1986, now U.S. Pat. No. 4,695,761; Ser. No. 835,845 filed Mar. 3, 1986, now U.S. Pat. No. 4,725,756; Ser. No. 866,030 filed Apr. 21 1986, now U.S. Pat. No. 4,737,681; Ser. No. 843,890 filed Mar. 25, 1986; Ser. No. 875,123 filed June 17, 1986; Ser. No. 881,169 filed June 30, 1986; and U.S. Pat. Nos. 3,894,321; 4,210,843; 4,547,696; 4,591,344; 4,593,224 and 4,595,857; the disclosures of which are hereby incorporated in this application by reference, and all being of common ownership herewith.

This specification includes an account of the background of the invention, a description of the the best mode presently contemplated for carrying out the invention, and appended claims.

BACKGROUND OF THE INVENTION

Field of the Invention

This invention relates to color cathode ray picture tubes, and is addressed particularly to the unexpected problem of dimensional instability in tension-type shadow masks which arose during heat cycling of such tubes during tube manufacture.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tension mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathode ray tube front assembly, and is located in spaced adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about one mil thick, or less. The mask must be supported in high tension a predetermined distance from the inner surface of the cathode ray tube faceplate; this distance is known as the "Q-distance." As is well known in the art, the shadow mask acts as a color-selection electrode or parallax barrier, which ensures that each of the three beams lands only on its assigned phosphor deposits on the screen.

General Prior Art

The following examples are being submitted to the Patent and Trademark Office for evaluation as to possible relevance to the claimed subject matter. The examples are believed to be the closest of the art of which applicant is aware, but applicant makes no admission as to its relevance in fact, to its legal sufficient, or to its priority in time, nor does applicant represent that no better art exists.

There have been a number of disclosures of tensed foil masks and means for applying and maintaining mask tension. Typical of these is the disclosure of Law in U.S. Pat. No. 2,625,734, which addresses the construction of a taut, planar, foraminous mask, and the mounting of the mask and target (the screen on the faceplate) as a unitary assembly within the envelope. The thin metal is clamped in a frame, and the mask is heated to a selected low temperature of about 100 degrees C. to expand it, then it is placed under screw tension. Upon cooling, the metal contracts and the mask is thus rendered taut and held in tension by the frame.

The method of thermally expanding the mask and permanently captivating it in a frame in an expanded condition is known commonly as "hot-blocking." Law accomplishes the expansion of the mask by means of heated platens applied to both sides of the mask. The mask may also be expanded by stretching it mechanically, by exposing it to infra-red radiation, or by resistively heating it by means of an electrical current.

The disclosure of U.S. Pat. No. 4,210,843 to Avedani, of common ownership herewith, depicts an improved method of making a color cathode ray tube shadow mask. The method comprises providing a plurality of shadow mask blanks each with a pattern of apertures photo-etched therein, which blanks have been cut from a foil of steel, precision cold-rolled to a full hard condition, and with a thickness of from 6 to 8 mils. The sheet is characterized by being composed of an interstitial free steel material. A stack of blanks is subjected to a limited annealing operation by being carried out at a relatively low maximum temperature, and for a relatively brief period sufficient only to achieve recrystallization of the material without causing significant grain growth. Each blank is clamped and drawn to form a dished shadow mask without the imposition of vibration or roller leveling operations, and thereby avoids the undesirable creasing, roller marking, denting, tearing or work-hardening of the blank normally associated with these operations. The end-product shadow mask, due to the use of the interstitial free steel material, has an aperture pattern of improved definition as a result of more uniform stretching of the mask blank.

In U.S. Pat. No. 3,894,321 to Moore, of common ownership herewith, there is disclosed a method for processing a color cathode ray tube having a thin foil mask sealed directly to the bulb of the tube. The bulb and foil are heated to about 425 degrees C., and the foil, stretched on a temporary frame, is placed over the bulb and sealed thereto by means of a devitrifying frit cement with the foil held firmly in place. The faceplate and funnel section are brought together in mating alignment, clamped together and then cooled. The mask is placed under tension as a result of differential contraction between the mask and the bulb as cooling proceeds. The temperature cited is maintained for about one hour, after which it is lowered at the rate of 3 to 5 degrees C. per minute; this slow rate of cooling is necessary to prevent cracking of the glass of the bulb.

In a journal article by Grimes et al, a process is described for tensing a flat shadow mask in a frame by hot-blocking. In a final step in which the tube is heated to a relatively high temperature and exhausted of air, it was found necessary to slow the cooling rate of the tube as the thin mask cooled more rapidly than the heavy frame on which it was mounted, resulting in a stretching of the mask beyond its elastic limit. ("Improvements in the RCA Three-Beam Shadow Mask Color Kinescope," Proceedings of the IRE, January 1954.)

Problems Leading To This Invention and Specific Prior Art

As noted, one of the advantages of the flat tension mask cathode ray tube is its power—handling capability which results from placing the mask under high tension—the greater the tension of the mask during tube operation, the greater its power handling capability and thus the greater its brightness/contrast performance.

It is of extreme importance that the mask's design tension level, once established, be maintained throughout the various stages of tube manufacture and thereafter during tube operation. Stability in level of tension translates into permanent stability in the dimensions of the mask during tube manufacture and operation. Any permanent change in the dimensions of the tension mask during tube manufacture or tube operation will result in changes in mask tension. For example, should the permanent length and/or width dimensions of a tension mask increase during tube manufacture or operation, the resulting reduction in mask tension will affect the performance of the tube. For example, a dimensional change of only 0.0002 inch can seriously degrade tube performance due to loss of guard band.

It was discovered that foil masks of flat tension mask tubes can unexpectedly lose their tension during manufacture, with the loss of tension being a permanent condition. Explorative efforts revealed that this critical problem appeared to be related to the relatively high temperatures the tubes experienced in final assembly. The maximum temperature required for proper frit sealing of the glass components of the tube envelope is about 435 degrees C., which is a temperature that has no deleterious effect on tubes having the conventional curved mask. The discovery of this unexpected vulnerability of the tensed foil mask to otherwise normal fritting temperatures raised serious doubts regarding the success of the entire production program. It was a problem of such magnitude that, unless it could be resolved, mass-manufacture of high-performance flat tension mask tubes was in question.

By the present invention, made in response to the unexpected problem, a novel and very specific sub-annealing temperature heat treatment is applied to the tension shadow mask, preferably before it enters the tube manufacturing processes, in order to eliminate, or at least reduce to acceptable levels, any permanent dimensional changes in the mask which might result from high temperatures encountered in the various tube manufacturing processes.

It is well known in the manufacture of standard color cathode ray tubes of the curved-mask, curved-screen type to heat-treat the shadow masks prior to their being formed into a domed shape. Conventional (non-tension) shadow masks are typically delivered to cathode ray tube manufacturers in a work-hardened state due to the multiple rolling operations which are performed on the steel to reduce it to the specified thickness, typically about 6 mils, for example. In order that the masks may be stamped into a domed shape, they must be softened by use of an annealing heat treatment—typically to temperatures in the order of 700–800 degrees C. After annealing, they are soft and can be formed into the desired domed configuration. Annealing also enhances the magnetic coercivity of the masks, a desirable property from the standpoint of magnetic shielding of the electron beams. After stamping, and the consequent moderate work hardening of the mask which may result from the stamping operation, it is known in the prior art to again anneal the masks while in their domed shape to further enhance their magnetic shielding properties.

Tension masks are also delivered in a hardened state—in fact, much harder than standard masks in order to provide the very high tensile strength needed to sustain the high tension levels which are desired in tension mask tubes—for example, 30,000 psi, or greater. The prior art annealing process, with its relatively high annealing temperatures, would be absolutely unacceptable if applied to flat tension masks, as any extensive softening or reduction of tensile strength of the mask resulting from the process would make it unsuitable for use as a tension mask.

Other Prior Art

U.S. Pat. Nos. 3,390,447; 3,809,945
Great Britain Pat. No. 1,163,495

OBJECT OF THE INVENTION

Accordingly, it is an object of the present invention to provide a reliable process for eliminating, or at least reducing to acceptable levels, any permanent changes in the dimensions of a tension type shadow mask resulting from subjection of the tensed mask to frit sealing and other normal heat cycles encountered during cathode ray tube manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 1 is a side view in perspective of a color cathode ray tube having a tensed foil shadow mask for which the treatment procedure of the present invention is intended, with cut-away sections that indicate the location of the mask and its relation to other major tube components; and FIG. 2 is a plan view of the front assembly the tube shown by FIG. 1 as seen from the electron gun end of the tube, indicating the relationship of the shadow mask and faceplate shown by FIG. 1; an inset depicts mask apertures greatly enlarged, and dimensions relevant to an understanding of the invention are indicated.

DESCRIPTION OF THE PREFERRED EMBODIMENT

A cathode ray tube having a flat tension mask pretreated by the process according to the invention is depicted in FIG. 1. The tube and its component parts are identified and described in the following paragraphs in this sequence: reference number, a reference name, and a brief description of structure, interconnections, relationship, functions, operation, and/or result, as appropriate.

(With Reference to FIGS. 1 and 2)

20—color cathode ray tube
22—faceplate assembly
24—faceplate
26—inner surface of faceplate
28—centrally disposed phosphor screen
30—film of aluminum
32—funnel
34—peripheral sealing area of faceplate, adapted to mate with a funnel
40A, 40B, 40C—V-grooves, which are components of ball-and-groove indexing means shown by way of example for registering the faceplate with the funnel
48—frame-like shadow mask support structure for receiving and securing a tensed foil shadow mask. By way of example, the structure may comprise four sections located on opposed sides of the screen. Also, the structure may be formed of metal, or have a metal cap to which a foil shadow mask may be attached as by welding or soldering
50—a metal foil shadow mask; after being tensed, the mask is mounted on mask support structure 48 and secured thereto; from the viewpoint of FIG. 2, shadow mask support structure 48 is shown by the dashed lines as underlying mask 50
52—inset, depicting shadow mask apertures greatly enlarged. The average diameter of each aperture is 0.003 inch, by way of example, and the apertures may number as many as 1,700,000 in a high-resolution cathode ray tube
56—anterior-posterior axis of tube
58—internal magnetic shield
60—internal electrically conductive coating on funnel
62—anode button
64—high-voltage conductor
66—neck of tube
68—in-line electron gun providing three discrete in-line electron beams for exciting the triads of phosphors deposited on screen 28
70, 72, 74—electron beams for activating respective red-light-emitting, green-light emitting, and blue-light-emitting phosphor deposits on screen 28
76—yoke which provides for the traverse of beams 70, 72 and 74 across screen 28
78—contact spring which provides an electrical path between the funnel coating 60 and the mask support structure 48

With respect to the installation of the metal foil shadow mask 50, it is expanded, or "tensed" either by heating it, or by stretching it mechanically. When in its expanded state, it is permanently secured in tension to the underlying shadow mask support 48 by means such as welding or soldering. A loss of tension, such as may result from the high-temperature processing of the tube in final assembly, reduces the beam-power-handling capability of the tube, and can produce color impurities due to a displacement of the apertures in the shadow mask with respect to the associated phosphor target elements.

The steel from which the masks are made is preferably a cold-rolled capped steel with an AISI rating of 1005. The material composition is preferably 0.04% silicon, 0.16% manganese, 0.028% carbon, 0.020% phosphorus, 0.018 sulfur, and 0.04% aluminum.

To achieve the desired pretreatment according to the invention, a stack of foil mask blanks, typically about 700 in quantity, is placed in a controlled-temperature oven. The blanks are in a related state; that is, they are not under tension. A non-oxidizing atmosphere, preferably in the form of nitrogen gas, is introduced, and the oven is raised to a temperature on the order of 470 degrees C. over a period of one hour, by way of example. The temperature is held at 470 degrees C. for about one and one-half hours, then the oven is cooled down to ambient temperature over a period of about two hours, also by way of example. It is noted that the rates of heating up and cooling down are not critical, as the rates are primarily a matter of the rate of heat transfer within the stack of mask blanks.

The test results that led to the process according to the present invention will now be described, with reference to Table I, Table II and FIG. 2.

TABLE I

| PROCESS Three firings in air for 2 hrs., 435 degrees C. maximum temperature | CHANGE (Mils/inch ± .05) Ls | Lh | Ss | Sh |
|---|---|---|---|---|
| First Firing | | | | |
| Mask 1 | 0.63 | .60 | .91 | .91 |
| Mask 2 | .44 | .48 | .87 | .83 |
| Second Firing | | | | |
| Mask 1 | .16 | .22 | 0 | .11 |
| Mask 2 | .06 | .10 | .07 | .07 |
| Third Firing | | | | |
| Mask 1 | .06 | .13 | .14 | .04 |
| Mask 2 | .10 | .06 | .07 | .11 |

Table I contains test data which reveals the aforedescribed unexpected dimensional instability of tension masks which is remedied by the present invention. Table 1 refers to mask dimensions "Ls", "Lh", "Ss" and "Sh", which are also indicated by FIG. 2. Ls is the long dimension of the tension mask measured from its outermost periphery, and Lh is the lengthwise dimension of the perforated portion of the mask. Similarly, Ss is the short dimension of the mask taken across its outer periphery; Sh is the shorter dimension of the perforated central portion of the mask. Table I reveals the permanent dimensional instabilities which resulted when two tension mask blanks were heated while relaxed to typical frit sealing temperatures—for example, about 435 degrees C. in a heat cycle extending over two hours. Data for two additional, substantially identical successive firings of the same blanks are shown in Table I. Note that the dimensional changes are not uniform. The mask blank did not act like an isotropic medium. Observe also that the dimensional changes were different between the two masks. And note that the permanent expansion of the perforated portion was in some cases greater than that of the overall dimension, suggesting that the permanent growth of the mask upon heating to frit-seal temperatures may be largely confined to the perforated portion of the mask, for reasons which are unknown.

In the second firing, it will be seen that whereas the data reveals a growth (with one exception) of the mask upon heating to frit-seal temperatures, the growth is significantly smaller than that which occurred during the first firing. Similarly, during the third firing of the same two masks, the dimensional changes were again in the direction of growth, but overall (with some puzzling deviations) are smaller than the growth which occurred in the second firing. The Table I data would thus suggest that, for best results after the second and third firings, the first firing should be performed at a higher temperature.

Table II which follows contains data which was taken on a second series of firings of two different masks, identified as masks 3 and 4. The 4th, 5th and 6th firings applied to masks 3 and 4 thus did not represent a repeat of the tests recorded in Table I. Instead, the first of the three firings was conducted in hydrogen for two hours at a temperature 35–40 degrees higher (about 470 degrees C.) than the highest temperature during the first three firings.

TABLE II

| PROCESS<br>Fourth firing in hydrogen<br>for 2 hrs., 470 C. max.<br>Fifth and sixth firings<br>are like first three. | CHANGE<br>(Mils/inch ± .05) | | | |
|---|---|---|---|---|
| | Ls | Lh | Ss | Sh |
| Fourth Firing | | | | |
| Mask 3 | −0.10 | −.10 | .36 | .33 |
| Mask 4 | 0 | .03 | .51 | .47 |
| Fifth Firing | | | | |
| Mask 3 | 0 | −.03 | 0 | .04 |
| Mask 4 | .03 | .03 | .04 | .04 |
| Sixth Firing | | | | |
| Mask 3 | .16 | .13 | .15 | .11 |
| Mask 4 | .13 | .06 | .11 | .07 |

It will be noted from the Table II data that something very unexpected happened. The data shows that the hydrogen firing at 470 degrees produced data not nearly as uniform as in the first firing in air recorded in Table I. Note that as a result of firing at 470 degrees in hydrogen, the dimensions Ls and Lh of masks 3 and 4 actually *decreased*, while the dimensions of the perforated portion *increased*, although less so than when masks 1 and 2 were first fired in air at frit-seal temperatures. While the cause of the differences between the tests is unknown, it will be seen from the data shown in Tables I and II that the permanent dimensional changes in masks 3 and 4 as a result of firing first in hydrogen at 470 degrees maximum temperature were much smaller than those which occurred when masks 1 and 2 were first fired in air.

While the test results seemed to be most favorable when the firing was accomplished in hydrogen, ensuing tests showed that the prime requirement was for a non-oxidizing atmosphere. Test results with both hydrogen and nitrogen atmospheres (both non-oxidizing gases) were compared, with the result that fewer fractures of the masks when tensed occurred as a result of exposure to a nitrogen atmosphere. So nitrogen provides the preferred atmosphere for pretreatment according to the invention.

It is extremely important to note that the favorable results obtained were by the use of heat treatments which were below the threshold of the annealing temperature of the metal of the masks; it is noted that the threshold temperature is about 500 degrees C. As described above, it is of great importance that the hardness of the mask material not be significantly reduced, and that its tensile strength be maintained at a high level in order that many tens of thousands of pounds per square inch of tension can be applied to the mask. If the masks were significantly annealed by subjection to temperatures in the range of 500 to 700 degrees C., by way of example, tensile strength would be reduced with the result that tension of the masks after installation in the tube could not be maintained.

Returning to Table II, it can be seen that the fifth firing (the second firing on masks 3 and 4), performed in air at frit-sealing temperatures, resulted in significantly smaller permanent dimensional changes in the mask than those which occurred when the first firing of the mask was performed in air at frit-sealing temperatures. It is also important to note, however, that the test data recorded in both Tables I and II indicate a significant reduction in the permanent dimensional changes of a tension mask if it is first fired at temperatures in the order of the temperatures encountered during frit-sealing, but significantly less than annealing temperatures.

The Vickers method of hardness testing is used to determine the hardness of the mask steel. This process is similar to the Rockwell test except that the indentor is a diamond in the form of a square pyramid having an apical angle of 136 degrees. The depth of the impression, which correlates with the hardness of the metal, is measured by means of a medium-power compound microscope. Hardness is expressed in terms of kilograms per square millimeter.

The hardness of a typical mask before it is subjected to the process according to the invention is about 200 Kg per square millimeter. Following the process, the hardness of typical masks is in the range of 130 to 160 Kg per square millimeter. This loss of hardness is considered to be acceptable as the processed masks retain enough residual hardness to maintain the applied tension.

Thus the invention concerns, in one aspect, a process for pre-treating a metal foil shadow mask for use in a color cathode ray tube wherein the mask is maintained under high tension within the tube. The tube is subjected to predetermined relatively high temperatures during tube manufacture. The process according to the invention comprises pre-heating the mask in a predetermined cycle of temperature and time effective to minimize subsequent permanent dimensional changes in the mask when subjected to the predetermined relatively high temperatures, but ineffective to significantly reduce the tensile strength of the mask by annealing. The process further comprises the step of placing the mask in a relaxed, untensioned condition, then preheating it to a temperature above the frit-sealing temperature, which is about 435 degrees C., but below the threshold of the annealing temperature of the mask, noted as being about 500 degrees C. According to the process of the invention, the mask is pre-heated to a temperature on the order of 470 degrees C. for about one and one-half hours. The mask is desirably heated in a non-oxidizing atmosphere, preferably of nitrogen.

In the manufacture of a color cathode ray tube, a steel foil tension mask is provided which is undesirably susceptible to permanent reduction of tension when subject to predetermined elevated temperatures during tube manufacture, the steps of which include heating the tube to the predetermined elevated temperature. According to the invention, the mask is preheated in a predetermined cycle of temperature and time as noted in the foregoing—a cycle effective to minimize subequent permanent dimensional changes in the mask when subjected to the predetermined elevated temperatures. The cycle of temperature and time according to the invention is, however, ineffective to reduce the tensile strength of the mask by annealing. As a result, the permanent reduction in tension otherwise resulting during tube manufacture is substantially alleviated.

The process according to the invention can be applied to the manufacture of shadow masks, and to the manufacture of front assemblies of cathode ray tubes. In the manufacture of a front assembly, a metal foil shadow mask, noted as being undesirably suceptible to permanent reduction in tension during tube, is provided. The mask is pre-treated according to the invention, following which it is installed in the front assembly. In final assembly, the tube is subjected to the frit-cycle temperature, noted as being about 435 degrees C., in the process of frit-sealing the tube; that is, permanently joining the sealing areas of the faceplate and funnel. Subsequent permanent dimensional changes in the mask that occur when the mask and tube are subjected to the elevated frit-cycle temperature are minimized by the process according to the invention.

The masks are preheated according to the invention in a non-oxidizing atmosphere of either hydrogen or nitrogen. Tests have shown an atmosphere of nitrogen to be preferable. It is essential that the masks not be oxidized as the existence of iron oxide can make necessary additional steps in production to remove the oxide.

While a particular embodiment of the invention has been shown and described, it will be readily apparent to those skilled in the art that changes and modifications may be made in the inventive process without departing from the invention in its broader aspects, and therefore, the aim of the appended claims is to cover all such changes and modifications as fall within the true spirit and scope of the invention.

I claim:

1. A process for manufacturing a flat tension mask color cathode ray tube having a flat faceplate, comprising:

providing a foil tension shadow mask composed of cold-rolled capped steel or other hardened steel material characterized by having the property that a tension mask fabricated therefrom has reduced tension upon being subjected to a conventional frit lehr heat cycle unless the preheat treatment of this process is applied;

preheating said shadow mask while in a relaxed state in a predetermined cycle of temperature and time effective to minimize subsequent permanent dimensional changes in said shadow mask when subjected to a frit lehr heat cycle, but ineffective to significantly reduce the tensile strength of said mask by annealing;

installing said mask on said faceplate under high tension; and frit sealing said faceplate to a funnel by the use of a frit cement, including subjecting the assembly to a frit lehr heat cycle, the completed assembly being characterized by said mask maintaining dimensional stability and thus retaining acceptable levels of tension despite its being subjected to said frit lehr heat cycle as a result of the stabilizing effects of said preheating of said mask while in a relaxed state.

2. A process for manufacturing a flat tension mask color cathode ray tube having a flat faceplate, comprising:

providing a foil tension shadow mask 1 mil or less thick composed of cold-rolled capped steel or other hardened steel material characterized by having the property that a tension mask fabricated therefrom has reduced tension upon being subjected to a conventional frit lehr heat cycle unless the preheat treatment of this process is applied;

preheating said shadow mask while in a relaxed state and in a non-oxidizing atmosphere to a temperature on the order of 470 degrees C. and for a time effective to minimize subsequent permanent dimensional changes in said shadow mask when subjected to a frit lehr heat cycle, but ineffective to significantly reduce the tensile strength of said mask by annealing;

installing said mask on said faceplate under high tension; and frit sealing said faceplate to a funnel by the use of a frit cement, including subjecting the assembly to a frit lehr heat cycle, the completed assembly being characterized by said mask maintaining dimensional stability and thus retaining acceptable levels of tension despite its being subjected to said frit lehr heat cycle as a result of the stabilizing effects of said preheating of said mask while in a relaxed state.

* * * * *